US006785509B1

(12) United States Patent
Hatazawa

(10) Patent No.: US 6,785,509 B1
(45) Date of Patent: Aug. 31, 2004

(54) CONVERTER FOR SATELLITE BROADCAST RECEPTION HAVING STRUCTURE FOR UNIFORM GROUNDING PRESSURE

(75) Inventor: Kenji Hatazawa, Tondabayashi (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/477,337

(22) Filed: Jan. 4, 2000

(30) Foreign Application Priority Data

Jan. 27, 1999 (JP) ..... H11-018222

(51) Int. Cl.[7] ..... H04H 1/100
(52) U.S. Cl. ..... 455/3.2; 455/300
(58) Field of Search ..... 455/300, 301, 455/302, 550, 90, 3.2; 361/750, 751, 752, 753, 814, 816, 818; 725/68

(56) References Cited

U.S. PATENT DOCUMENTS 4,680,676 A * 7/1987 Petratos et al. ..... 361/818
5,252,782 A * 10/1993 Cantrell et al. ..... 174/35
5,778,880 A * 7/1998 Chen ..... 128/696
5,927,240 A * 7/1999 Maxon ..... 123/179.3
5,951,178 A * 9/1999 Lim ..... 400/472
6,343,732 B1 * 2/2002 Gravesw et al. ..... 228/39

FOREIGN PATENT DOCUMENTS

| | | |
|---|---|---|
| JP | 4-43030 | 4/1992 |
| JP | 6-44679 | 6/1994 |
| JP | 2785753 | 5/1998 |

OTHER PUBLICATIONS

Japan Institute of Invention and Innovation's Journal of Technical Disclosure No. 94–10911, issued on June 1, 1994.

* cited by examiner

*Primary Examiner*—Charles Appiah
*Assistant Examiner*—Naghmeh Mehrpour
(74) *Attorney, Agent, or Firm*—Nixon & Vanderhye PC

(57) ABSTRACT

In a converter for satellite broadcast reception having a fixing structure provided with a circuit board, a plurality of radio-frequency circuits mounted on the circuit board and separated from one another by a grounding pattern, a chassis having ribs arranged in a pattern that corresponds to the grounding pattern, and a mount plate placed on the back surface of the circuit board, a rubber plate having resilience is placed between the circuit board and the mount plate. This permits the grounding pressure with which the grounding pattern of the circuit board is kept in contact with the chassis to be distributed uniformly, and thereby permits stable grounding to be achieved.

32 Claims, 5 Drawing Sheets

CONVERTER FOR SATELLITE BROADCAST RECEPTION HAVING STRUCTURE FOR UNIFORM GROUNDING PRESSURE

BACKGROUND OF THE INVENTION

1. Field of the Invention

The present invention relates to a converter for satellite broadcast reception, and particularly to a structure for fixing a circuit board to a chassis.

2. Description of the Prior Art

FIG. 7 is a general view of an antenna incorporating a converter for satellite broadcast reception. Reference numeral 1 represents the converter proper, which is composed of an RF (radio frequency) circuit board built in a chassis 1*a* made of aluminum or zinc, and which is covered with a cabinet 2. A radio wave transmitted from a satellite is reflected from a parabolic antenna 3 so as to be received by a horn portion 4 provided at one end of the converter proper 1, and is then fed to the circuit board built in the converter. Thereafter, the received radio wave, which is in the 12 GHz band, is converted into a signal in the 1 GHz band by the circuit board built in the converter, and is then fed to a tuner unit by way of a coaxial cable 5.

Quite naturally, these components are expected to endure a harsh outdoor environment all over the world, i.e. all kinds of hostile use conditions including natural phenomena such as heating by sunlight, an abrupt temperature fall by a squall or the like, vibrations by a wind storm, and day-to-night temperature variations. Thus, the circuit board needs to be fixed to the chassis in such a way as to maintain stable grounding even in such an environment, and, in particular in a converter for satellite broadcast reception, which is designed for use in an extremely high frequency band, it is essential to secure good grounding.

Moreover, in particular in an apparatus such as a converter for satellite broadcast transmission/reception designed for use in an outdoor environment, it is necessary to enable it to endure abrupt temperature variations (e.g. in a range from −40° to 70°), vibrations (e.g. the vibrations of an antenna), and the like by devising a structure that absorbs the thermal expansion, plastic deformation, and the like of its constituent components.

Conventionally, for example, Japanese Published Patent No. 2785753 proposes securing good grounding between a chassis and the ground pattern of a circuit board by forming, in through holes provided in the ground pattern of the circuit board, a prepreg layer that protrudes through the through holes, and then metal-plating this protruding prepreg layer so that grounding between the chassis and the ground pattern of the circuit board will be achieved securely by way of the through holes.

Japanese Laid-Open Patent Application No. S63-158898 proposes a shielding structure for an RF circuit device in which good grounding is secured by forming, on the ribs of a chassis, projections made of soft metal, such as solder bumps, so that, when a circuit board is fixed to the chassis with screws, the projections will be deformed in such a way as to make close contact with the ground pattern of the circuit board.

Japan Institute of Invention and Innovation's Journal of Technical Disclosure No. 94-10911 proposes forming, on the ribs of a chassis, projections that cut into a circuit board so that, when the circuit board is fixed to the chassis with screws, the projections will deform the circuit board in such a way as to secure good grounding.

These prior-art techniques all serve the purpose of securing good grounding, but simultaneously cause deformation in the circuit board and in the projections formed on the chassis ribs. This is undesirable in particular when, after initial assembly, the circuit board, chassis, or other component is found defective and thus reassembly is needed, or those components are used in a harsh temperature environment, because deformation, dents, and the like in the projections and in the circuit board remain and eventually degrade reliability and performance, as by making it difficult to secure stable grounding or by weakening the shielding effect.

On the other hand, Japanese Laid-Open Utility Model Application No. H4-43030 proposes placing a resilient grounding member between the grounding surface of a circuit board and the mount surface of a chassis so that, even if there are irregularities on the mount surface of the chassis, the grounding surface and the mount surface are kept in contact with each other uniformly.

This prior-art technique serves the purpose of securing good grounding, but not satisfactorily secure grounding with a converter for satellite broadcast reception, which is used in an extremely high frequency band.

SUMMARY OF THE INVENTION

An object of the present invention is to provide a structure for fixing a circuit board to a chassis that permits the grounding pressure with which the grounding pattern of the circuit board is kept in contact with the chassis to be distributed uniformly and that thereby permits secure grounding to be maintained even against violent variations in environmental conditions, vibrations, and other factors.

To achieve the above object, according to one aspect of the present invention, in a converter for satellite broadcast reception having a fixing structure that is provided with a circuit board, a plurality of radio-frequency circuits mounted on the circuit board and separated from one another by a grounding pattern, a chassis having ribs arranged in a pattern that corresponds to the grounding pattern, and a mount plate placed on the back surface of the circuit board, a rubber plate having resilience is placed between the circuit board and the mount plate.

According to another aspect of the present invention, in a converter for satellite broadcast reception having a fixing structure that is provided with a circuit board, a plurality of radio-frequency circuits mounted on the circuit board and separated from one another by a grounding pattern, a chassis having ribs arranged in a pattern that corresponds to the grounding pattern, and a mount plate placed on the back surface of the circuit board, the mount plate has rubber printed (formed) thereon in a pattern that corresponds to the grounding pattern.

These structures permit the grounding pressure with which the grounding pattern of the circuit board is kept in contact with the chassis to be distributed uniformly, and thereby permit secure grounding to be achieved in various environments.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

First Embodiment

Figure 1:
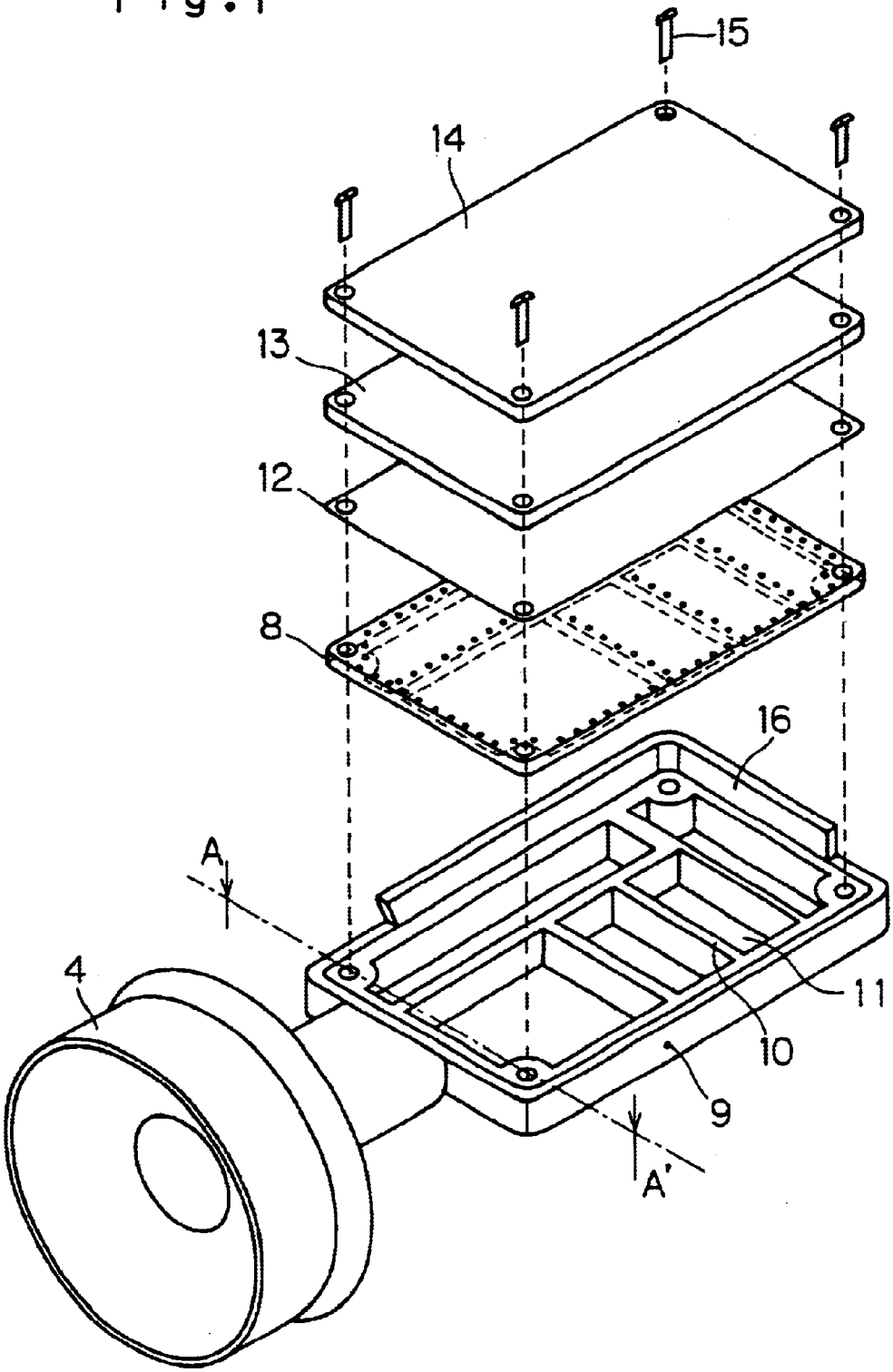
FIG. 1 is a perspective view of the structure for fixing a circuit board to a chassis used in a first embodiment of the invention.
Figure 2A:
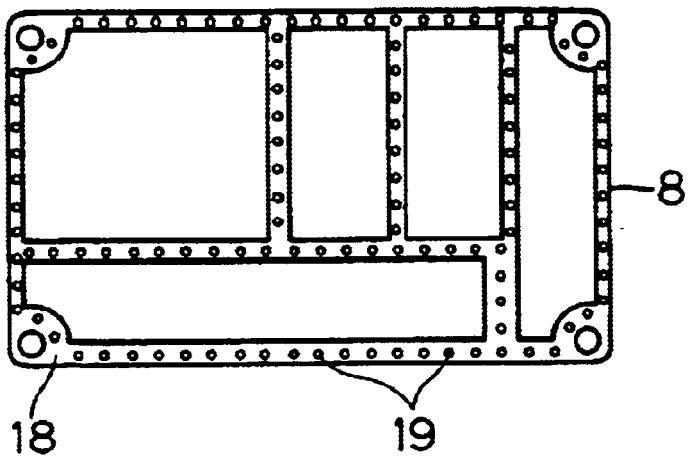
FIG. 2A is a top view of the circuit board used in the structure shown in FIG. 1.
Figure 2B:
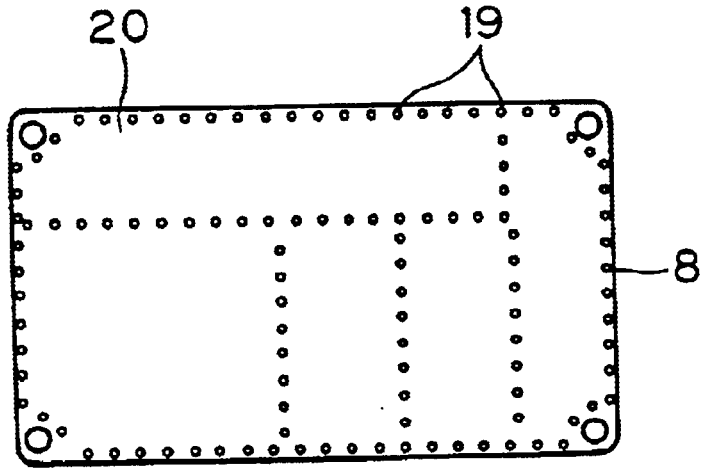
FIG. 2B is a bottom view of the circuit board used in the structure shown in FIG. 1.

Hereinafter, a converter for satellite broadcast reception will be described as a first embodiment of the present invention with reference to FIGS. 1 to 4. FIG. 1 is a perspective view of the structure for fixing a circuit board to a chassis used in the first embodiment of the invention. FIGS. 2A and 2B are a top view (obverse side) and a bottom view (reverse side), respectively, of the circuit board used in the structure shown in FIG. 1.

The circuit board 8 has a plurality of radio-frequency circuits (of which the circuit patterns and mounted components are omitted in the figures) mounted on the top surface thereof. These radio-frequency circuits are separated from each other by a grounding pattern 18 laid on the top surface of the circuit board 8. The circuit board 8 has a grounding pattern 20 laid all over the back surface thereof. The top and back surfaces of the circuit board 8 are electrically connected together by through holes 19 formed in the grounding pattern 18.

Reference numeral 9 represents a shielding chassis of the converter, which is formed out of, for example, aluminum or zinc. The chassis 9 has ribs 10 formed in a pattern that corresponds to the grounding pattern 18 laid on the top surface of the circuit board 8, and these ribs 10 form shielded spaces individually for the radio-frequency circuits mounted on the top surface of the circuit board 8.

Reference numeral 12 represents metal foil, which is, for example, aluminum or copper formed into foil having a thickness of 0.1 to 0.2 mm. Reference numeral 13 represents a rubber plate, which is, for example, silicone rubber, EPDM urethane rubber, or the like produced in the form of a sheet or formed into a shape that fits the size of the circuit board 8. Reference numeral 14 represents a mount plate, which is formed out of, for example, sheet metal, aluminum, or zinc. Reference numeral 15 represents fixing screws.

Figure 3:
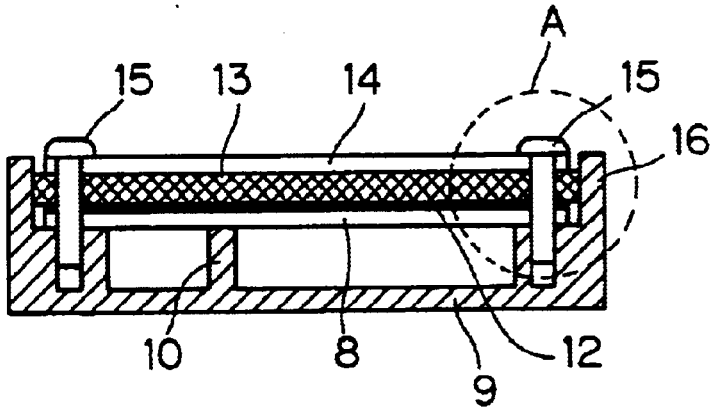
FIG. 3 is a sectional view, taken along the line A–A', of the structure shown in FIG. 1 in its assembled state.
Figure 4:
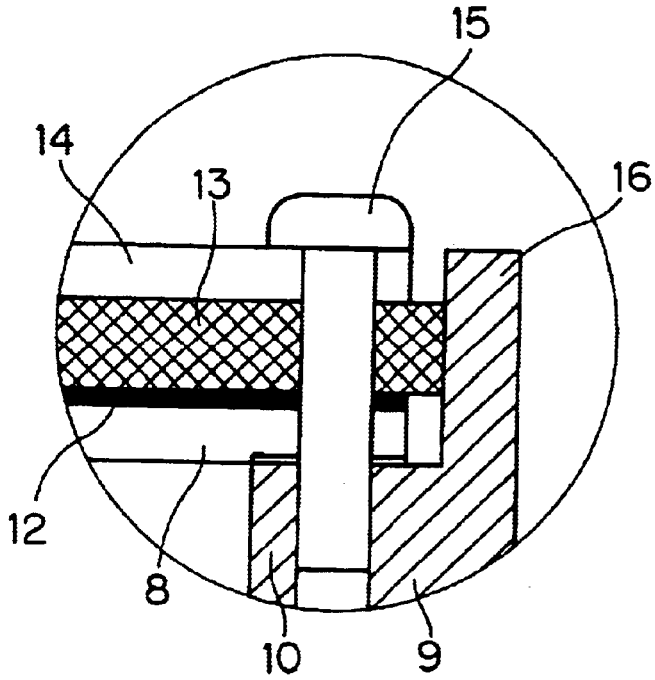
FIG. 4 is an enlarged sectional view of the part A shown in FIG. 3.

FIG. 3 is a sectional view, taken along the line A–A', of the structure shown in FIG. 1 in its assembled state, and FIG. 4 is an enlarged sectional view of the part A shown in FIG. 3.

As shown in FIG. 3, owing to the rubber plate 13 placed between the back surface of the circuit board 8 and the mount plate 14, when the circuit board 8 is fixed with fixing screws 15, it is possible to distribute the load uniformly over the entire circuit board 8. As a result, satisfactory grounding is achieved between the chassis ribs 10 and the grounding pattern 18 laid on the top surface of the circuit board. In this way, the presence of the rubber plate 13 permits the load from the mount plate 14 to press the circuit board 8 with uniformly distributed pressure, and thus alleviates uneven distribution of pressure over the circuit board 8 and bulges between the screws 15 as typically occur during assembly. Since the pressure is kept uniform in various environments, stable grounding is achieved.

Even in case of disassembly of a product, the deformation and the like of its components are kept to a minimum, and therefore reassembly is possible without any appreciable loss in the reliability and performance of the product.

In a converter for satellite broadcast reception, which is used in a frequency band as high as 12 GHz, even more secure grounding is required on the back surface of the circuit board. In this embodiment, as illustrated in the figures directed thereto, the metal foil 12 placed between the back surface of the circuit board 8 and the rubber plate 13 permits the metal foil 12 to be kept in close contact with the circuit board 8 without spoiling the flexibility of the rubber plate 13, and thereby makes it possible to achieve secure grounding on the back surface of the circuit board.

Instead of using the metal foil 12, it is also possible to vapor-deposit a metal film on the rubber plate 13. This makes it possible to omit assembly steps related to the metal foil 12, and thereby enhance assembly efficiency. Similarly, to enhance assembly efficiency, it is also possible to form the metal foil 12 and the mount plate 14 integrally or bond them together with adhesive between them into a single component.

Moreover, the rubber plate 13 may be made of a material that contains an electrically conductive material such as metal powder, ferrite, or a similar material from the beginning. By placing the rubber plate 13 containing such an electrically conductive material in contact with the outer casing 16 of the chassis that lie further outside the outer edge of the circuit board 8, it is possible to eliminate leakage of a radio wave through the gap between the circuit board 8 and the chassis 10.

Furthermore, in the structure described above, by forming circular projections, or minute linear projections arranged in a grid-like pattern, on the rubber sheet 13 or on the metal foil 12, it is possible to convert the plane load into a set of point or line loads so that stable grounding will be achieved between the circuit board 8 and the chassis 10 and/or the metal foil 12 with a smaller load. In this case, since stable grounding is achieved with a smaller load, a sufficient grounding pressure is secured without the use of fixing screws or the like, for example simply by press-fitting the mount plate 14 or by crimping the chassis.

Second Embodiment

Figure 5:
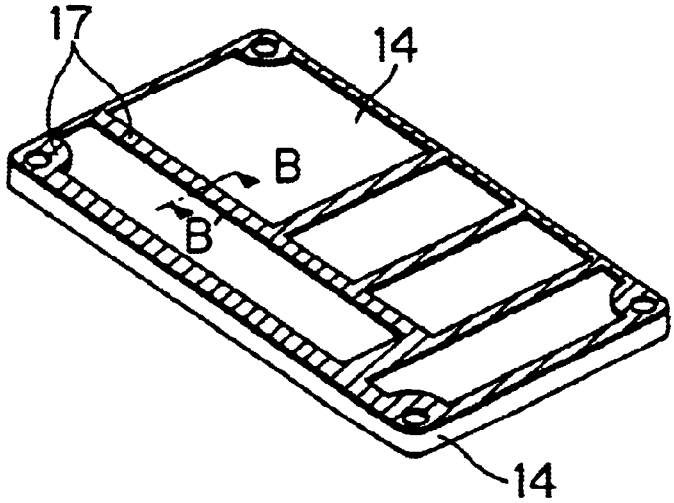
FIG. 5 is a perspective view of the mount plate used in a second embodiment of the invention.
Figure 6:
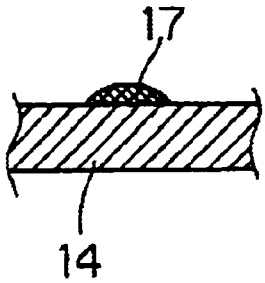
FIG. 6 is a sectional view, taken along the line B–B', of the mount plate shown in FIG. 5.
Figure 7:
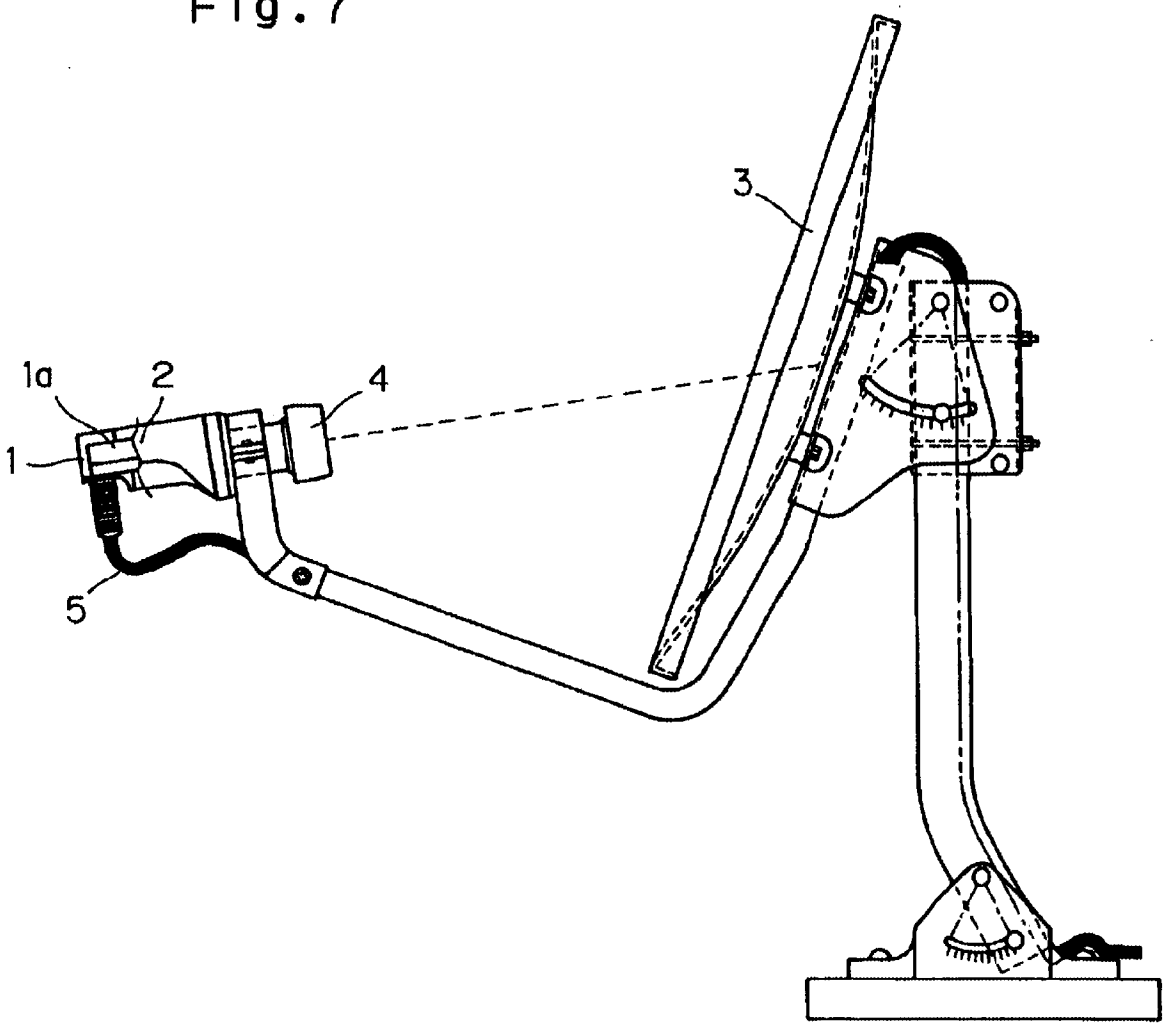
FIG. 7 is a side view of an antenna incorporating a converter for satellite broadcast reception.

Next, another converter for satellite broadcast reception will be described as a second embodiment of the present invention with reference to FIGS. 5 and 6. FIG. 5 is a perspective view of the mount plate used in the second embodiment, and FIG. 6 is a sectional view, taken along the line B–B', of the mount plate shown in FIG. 5.

As shown in FIG. 5, in this embodiment, instead of using a rubber plate 13 as in the first embodiment, a rubber print 17 is applied directly to the mount plate 14. This rubber print 17 is formed by a printing process like that of silk-screen printing using an appropriate amount of rubber in a liquid state. This structure permits rubber to be formed into a pattern that corresponds to the grounding pattern, and even into any other pattern, with ease and at low cost.

Obviously, many modifications and variations of the present invention are possible in light of the above teachings. It is therefore to be understood that within the scope of the appended claims, the invention may be practiced other than as specifically described.

What is claimed is:

1. A converter for satellite broadcast reception having a fixing structure comprising:

a circuit board having an obverse side and a reverse side;

a plurality of radio-frequency circuits mounted on the obverse side of the circuit board and separated from one another by a grounding pattern laid on the obverse side of the circuit board;

a chassis having ribs arranged in a pattern that corresponds to the grounding pattern;

a rubber plate having resilience and having one side covering substantially an entire area of said reverse side of the circuit board; and a mount plate covering substantially an entire area of the other side of said rubber plate.

2. A converter for satellite broadcast reception as claimed in claim 1, further comprising metal foil laid on the reverse one side of the circuit board.

3. A converter for satellite broadcast reception as claimed in claim 2, said metal foil being integral with the rubber plate.

4. A converter for satellite broadcast reception as claimed in claim 2, said metal foil having minute projections formed thereon.

5. A converter for satellite broadcast reception as claimed in claim 3, said metal foil having minute projections formed thereon.

6. A converter for satellite broadcast reception as claimed in claim 1, further comprising a metal film formed at least on the one side of the rubber plate that covers the reverse side of the circuit board.

7. A converter for satellite broadcast reception as claimed in claim 1, said rubber plate being made of a rubber material containing an electrically conductive material.

8. A converter for satellite broadcast reception as claimed in claim 1, said rubber plate having minute projections formed on the one side that covers the reverse side of the circuit board.

9. A converter for satellite broadcast reception having a fixing structure comprising:

a circuit board having an obverse side and a reverse side;

a plurality of radio-frequency circuits mounted on the obverse side of the circuit board and separated from one another by a grounding pattern laid on the obverse side of the circuit board;

a chassis having ribs arranged in a pattern that corresponds to the grounding pattern; and a mount plate covering substantially an entire area of the reverse side of the circuit board, said mount plate having rubber printed thereon in a pattern that corresponds to the grounding pattern.

10. A converter for satellite broadcast reception as claimed in claim 9, further comprising metal foil being laid on the reverse side of the circuit board.

11. A converter for satellite broadcast reception as claimed in claim 10, said metal foil being integral with the mount plate.

12. A converter for satellite broadcast reception as claimed in claim 10, said metal foil having minute projections formed thereon.

13. A converter for satellite broadcast reception as claimed in claim 11, said metal foil having minute projections formed thereon.

14. A converter for satellite broadcast reception as claimed in claim 9, further comprising a metal film formed at least on a surface of the printed rubber and kept in contact with the reverse side of the circuit board.

15. A converter for satellite broadcast reception as claimed in claim 9, said printed rubber being made of a rubber material containing an electrically conductive material.

16. A converter for satellite broadcast reception as claimed in claim 9, said printed rubber having minute projections formed on a surface thereof and said minute projections being in contact with the reverse side of the circuit board.

17. A converter installable in an outdoor environment for satellite broadcast reception having a fixing structure comprising:

a circuit board having an obverse side and a reverse side;

a plurality of radio-frequency circuits mounted on the obverse side of said circuit board and separated from one another by a first grounding pattern formed on the obverse side of said circuit board;

a second grounding pattern formed on substantially an entire area of the reverse side of said circuit board and electrically connected to the first grounding pattern by way of through holes;

a chassis having ribs arranged in a pattern that corresponds to the first grounding pattern;

a rubber plate having resilience and having one side covering substantially an entire area of the reverse side of the circuit board;

a mount plate covering substantially an entire area of the other side of said rubber plate; and fixing means for securing said mount plate to said chassis with said circuit board and said rubber plate disposed therebetween, wherein said rubber plate substantially maintains uniform pressure on said circuit board to achieve stable grounding connections.

18. A converter for satellite broadcast reception as claimed in claim 17, further comprising metal foil laid on the reverse side of the circuit board.

19. A converter for satellite broadcast reception as claimed in claim 18, said metal foil being integral with the rubber plate.

20. A converter for satellite broadcast reception as claimed in claim 18, said metal foil having minute projections formed thereon.

21. A converter for satellite broadcast reception as claimed in claim 19, said metal foil having minute projections formed thereon.

22. A converter for satellite broadcast reception as claimed in claim 17, further comprising a metal film formed at least on the one side of the rubber plate that covers the reverse side of the circuit board.

23. A converter for satellite broadcast reception as claimed in claim 17, said rubber plate being made of a rubber material containing an electrically conductive material.

24. A converter for satellite broadcast reception as claimed in claim 17, said rubber plate having minute projections formed on the one side that covers the reverse side of the circuit board.

25. A converter installable in an outdoor environment for satellite broadcast reception having a fixing structure comprising:

a circuit board having an obverse side and a reverse side;

a plurality of radio-frequency circuits mounted on the obverse side of said circuit board and separated from one another by a first grounding pattern formed on the obverse side of said circuit board;

a second grounding pattern formed on substantially an entire area of the reverse side of said circuit board and electrically connected to the first grounding pattern by way of through holes;

a chassis having ribs arranged in a pattern that corresponds to the first grounding pattern;

a mount plate having one side covering substantially an entire area of the reverse side of the circuit board, wherein said mount plate has rubber printed on said one side in a pattern that corresponds at least to the first grounding pattern, and the rubber is brought into contact with the second grounding pattern; and fixing means for fixing the circuit board between said chassis and said mount plate.

26. A converter for satellite broadcast reception as claimed in claim 25, further comprising metal foil being laid on the reverse side of the circuit board.

27. A converter for satellite broadcast reception as claimed in claim 26, said metal foil being integral with the mount plate.

28. A converter for satellite broadcast reception as claimed in claim 26, said metal foil having minute projections formed thereon.

29. A converter for satellite broadcast reception as claimed in claim 27, said metal foil having minute projections formed thereon.

30. A converter for satellite broadcast reception as claimed in claim 25, further comprising a metal film formed at least on a surface of the printed rubber and kept in contact with the reverse side of the circuit board.

31. A converter for satellite broadcast reception as claimed in claim 25, said printed rubber being made of a rubber material containing an electrically conductive material.

32. A converter for satellite broadcast reception as claimed in claim 25, said printed rubber having minute projections formed on a surface thereof and said minute projections being in contact with the reverse side of the circuit board.

* * * * *